United States Patent [19]

Stewart

[11] Patent Number: 4,790,519

[45] Date of Patent: Dec. 13, 1988

[54] BORDERWIRE HINGE CLIP

[75] Inventor: Gary M. Stewart, Rensselaer, Ind.

[73] Assignee: Sealy, Incorporated, Chicago, Ill.

[21] Appl. No.: 946,973

[22] Filed: Dec. 29, 1986

[51] Int. Cl.[4] ..... F16F 3/00; A47C 23/02

[52] U.S. Cl. ..... 267/106; 5/250; 5/270; 267/103

[58] Field of Search ..... 267/80, 91, 95, 97, 267/103, 105, 106, 110, 111, 112; 5/250, 259 R, 259 B, 270

[56] References Cited

U.S. PATENT DOCUMENTS

| | | | |
|---|---|---|---|
| 356,114 | 1/1887 | Foster et al. | 5/250 |
| 521,018 | 6/1894 | De Mott | 5/259 B |
| 1,006,750 | 10/1911 | Hattler | 5/259 B |
| 1,177,096 | 3/1916 | Fitzsimmons | 5/259 B |
| 1,285,721 | 11/1918 | Johnston | 5/250 |
| 1,665,534 | 4/1928 | D'Arcy | 5/259 B X |
| 1,958,798 | 5/1934 | Owen et al. | 5/270 X |

*Primary Examiner*—Andres Kashnikow
*Assistant Examiner*—Robert J. Oberleitner
*Attorney, Agent, or Firm*—Willian Brinks Olds Hofer Gilson & Lione Ltd.

[57] ABSTRACT

A clip for use in a hinged border wire assembly, such as a border wire assembly used in a mattress, joins border wire portions together in a manner that permits one border wire section to rotate with respect to the other. This permits folding of a large border wire of the type that would be used on a king-size mattress, for example, in order to pass the mattress through small areas such as doors and stairways. The disclosed embodiment has two border wire sections which are generally U-shaped and which abut along portions formed at the ends of each U. The clip has a pair of adjacent sleeves within which respective abutting border wire portions are received. A barb is formed inwardly of a sleeve to secure the barbed sleeve in place on its border wire portion while allowing the other abutting portion to rotate within its sleeve in hinged fashion.

2 Claims, 1 Drawing Sheet

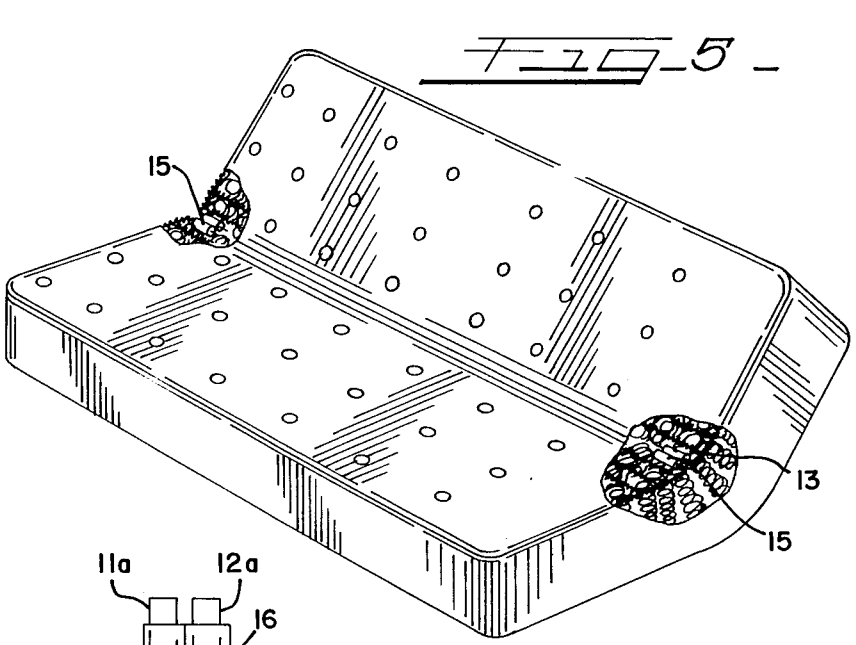
FIG-5
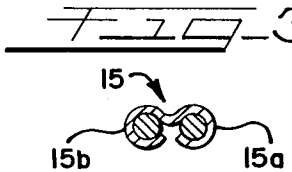
FIG-3
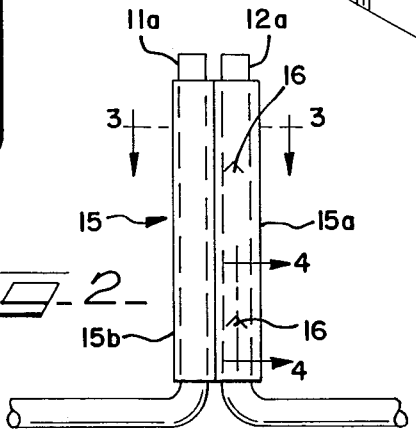
FIG-2
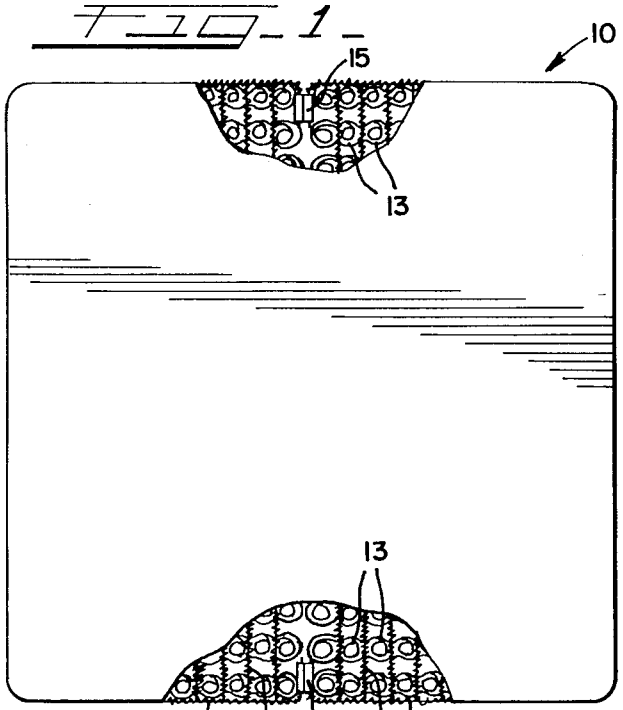
FIG-1
FIG-4
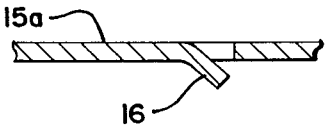

BORDERWIRE HINGE CLIP

FIELD OF THE INVENTION

This invention relates to border wire assemblies formed of sections that are joined together in a manner permitting the sections to rotate relative to one another.

BACKGROUND OF THE INVENTION

Border wires are commonly used with spring cushion products, such as mattress innerspring assemblies. A plurality of coil springs are arranged to form a support area for the mattress, with the coil springs joined together into a unit, such as by crosshelical springs extending across the length and width of the mattress. A border wire extends around a perimeter meter defined by the coil springs along the outside of the support area. The border wire fixes the edge of the innerspring assembly and provides an extra degree of firmness around the innerspring perimeter.

In large innerspring units, such as those used in kingsize mattresses, the border wire is formed in two U-shaped pieces. The U-shaped pieces meet or abut one another along portions of the border wire at the ends of each U that are bent inwardly (i.e. into the mattress). The inwardly extending abutting portions are typically joined together by helical coils, for example. This permits the border wire sections to rotate with respect to each other. The large innerspring can thus be folded to pass through small areas such as doors, stairways, elevators and the like.

SUMMARY OF THE INVENTION

The present invention relates to a hinge clip for holding two adjacent portions of a border wire assembly together which provides a positive lock and a tight grip on the border wire portions. The hinge clip is also readily attached to the border wire portions in a labor-saving manner.

To these ends, the present invention comprises a clip for joining together first and second border wire sections which together form a complete border wire. The border wire sections, which generally will be U-shaped, have portions formed on respective border wire ends that will ordinarily extend inwardly (i.e. perpendicular to the legs of each U and into the mattress).

The hinge clip of this invention has a longitudinal axis with sleeves formed on either side of the axis. Adjacent inwardly extending border wire portions are received in respective sleeves. At least one barb is formed to extend into the sleeve to secure this barbed sleeve in place on its respective border wire portion. Although this barbed sleeve is substantially fixed on its border wire portion, the adjoining border wire portion is preferably free to rotate within its sleeve. The two border wire sections are thus joined in a hinged relationship which permits the border wire to be "folded."

The foregoing features and advantages of this invention will be further understood upon consideration of the following detailed description of an embodiment of the invention taken in conjunction with the accompanying drawings, in which:

BRIEF DESCRIPTION OF THE DRAWINGS

FIG. 1 is a plan view of a mattress innerspring made in accordance with the teachings of this invention;

FIG. 2 is an enlarged view of the clipped portions of the border wire shown in FIG. 1;

FIG. 3 is a cross-sectional view taken along line 3—3 of FIG. 2;

FIG. 4 is an enlarged sectional view taken along line 4—4 of FIG. 2 prior to attachment to the border wire portions; and FIG. 5 is a perspective view of the mattress of FIG. 1 illustrating the utility of the hinged clip in folding the mattress (the size of the clips being exaggerated for clarity).

DETAILED DESCRIPTION OF AN EMBODIMENT OF THE INVENTION

The present invention is hereafter described in its application in a border wire assembly for a mattress innerspring uint. It will of course be understood that, while it is described in this particular environment, the clip is considered to have utility in other products utilizing a border wire and the like.

Mattress 10 of FIG. 1 has upper and lower border wires each made of two generally U-shaped sections 11 and 12. The particular mattress 10 illustrated is a kingsize mattress having a lateral width of about 74 and ½ inches. Spring coils 13 are organized into a support area, such as in columns and rows of coils. The coils 13 are all joined together in a conventional fashion, such as through the use of cross-helical springs 14 which lace adjacent terminal convolutions of the spring coils 13 along the rows and/or columns. The border wire 11, 12 surrounds the perimeter of the spring coil support area and is fixed to the terminal convolutions of the edge coils, as by clipping, helical lacing or hog ringing. A typical border wire would be made of a rigid 8 gauge steel, for example.

At the end of the legs of each of the border wire U's 11, 12, a small portion of border wire 11*a* and 12*a* is bent inwardly (into the plane defined by the assembled border wire). These inwardly bent portions 11*a*, 12*a* are generally perpendicular to the legs of the U and meet or generally abut each other in assembled relationship (FIG. 2).

The abutting border wire portions 11*a*, 12*a* are joined together with hinge clip 15. The clip 15 is made of spring steel in this embodiment, with a pair of side-by-side sleeves 15*a*, 15*b* forming the major portion of the clip 15. In the illustrated embodiment, the clip has a longitudinal length of about 2 inches.

A pair of barbs 16 (FIG. 4) are provided off-axis of the clip 15, extending inwardly of a sleeve, such as sleeve 15*a*, within which one of the two abutting border wire portions 11*a*, 12*a* is received. The barbs 16 are struck from a clip blank in formation of the clip.

The clip 15 is applied to abutting border wire portions 11*a*, 12*a* by sliding the formed clip 15 onto the border wire portions 11*a*, 12*a* with the barbs 16 pointing downstream (inwardly). The barbs 16 substantially fix their sleeve on its border wire portion (here 12*a*). The other border wire portion (here 11*a*) is relatively free to rotate within its clipped sleeve.

The sections 11, 12 of each of the assembled border wires are thus able to rotate with respect to each other in a hinged fashion. This is illustrated in FIG. 5. A large mattress, such as the depicted kingsize mattress, can thus be "folded" to reduce its width in order to more easily fit through small places such as doors and stairways.

While the invention has been described with reference to a particular embodiment, further applications and modifications of the invention will be apparent to others, yet still fall within the scope of this invention.

I claim:

1. A spring assembly comprising:

a plurality of springs organized into a support area, means for retaining said springs in said support area, a border wire assembly surrounding said support area, and having a first border wire section and a second border wire section which meet along portions formed on each border wire section, said border wire sections being generally U-shaped with said border wire portions being formed at the ends of each U and extending inwardly of said support area.

and a clip for joining said border wire portions together, said clip being stamped in a single piece and having a longitudinal axis with sleeves formed on either side of said axis in which said respective border wire portions are received, with at least one barb having a pointed barb end formed inwardly of a sleeve with said barb end pointed generally parallel to said longitudinal axis to secure said barbed sleeve in place on its respective border wire portion through sliding said clip on juxtaposed border wire portions of respective border wire sections with said barb pointing opposite the direction of sliding, said clip permitting said border wire sections to freely rotate with respect to each other.

2. A hinged border wire assembly, such as for a spring cushion product, comprising:

a first border wire section and a second border wire section which together form a complete border wire, said border wire generally defining a plane, said first and second border wire sections abutting along portions formed on respective border wire sections which border wire portions extend inwardly of said plane and terminate in free ends, and a clip which is formed in a single piece for joining said abutting border wire portions together having a longitudinal axis with sleeves formed on either side of said axis within which said respective abutting border wire portions are received, with at least one barb having a pointed barb end formed inwardly of a sleeve with said barb extending generally parallel to said longitudinal axis to secure said barbed sleeve in place on its respective border wire portion through sliding attachment of said clip over said free ends of abutting border wire portions of respective border wire sections and onto said abutting border portions with said barb pointing opposite the direction of sliding attachment.

* * * * *

UNITED STATES PATENT AND TRADEMARK OFFICE

CERTIFICATE OF CORRECTION

PATENT NO. : 4,790,519

DATED : December 13, 1988

INVENTOR(S) : Gary M. Stewart

It is certified that error appears in the above-identified patent and that said Letters Patent is hereby corrected as shown below:

In column 1, line 16, please delete "meter".

In column 2, line 17, please delete "uint" and substitute therefor --unit--.

In column 4, line 25, after "border" please insert --wire--.

Signed and Sealed this

Twenty-fifth Day of June, 1991

*Attest:*

*Attesting Officer*

HARRY F. MANBECK, JR.

*Commissioner of Patents and Trademarks*